United States Patent [19]

Wicklein

[11] Patent Number: 4,789,363

[45] Date of Patent: Dec. 6, 1988

[54] VISUAL INDICATING PLUG FOR OUTBOARD MARINE ENGINES

[76] Inventor: Roger Wicklein, P.O. Box 688, Rockaway Beach, Mo. 65740

[21] Appl. No.: 100,968

[22] Filed: Sep. 25, 1987

[51] Int. Cl.[4] ..... B63H 21/38

[52] U.S. Cl. ..... 440/2; 116/276; 184/96; 184/108; 220/82 A; 440/78; 440/88

[58] Field of Search ..... 440/78, 88, 2, 76; 184/6.4, 96, 108; 220/82 R, 82 A, 82.5; 116/276

[56] References Cited

U.S. PATENT DOCUMENTS

| | | | |
|---|---|---|---|
| 2,345,889 | 4/1944 | Talbot | 116/276 |
| 2,374,142 | 4/1945 | Steven | 220/82.5 |
| 2,638,810 | 5/1953 | Berleme | 220/82 R |
| 2,917,924 | 12/1959 | Messick | 220/82 R |

FOREIGN PATENT DOCUMENTS

| | | | |
|---|---|---|---|
| 679269 | 2/1964 | Canada | 220/82 R |
| 973022 | 8/1975 | Canada | 440/88 |
| 1374603 | 8/1964 | France | 116/276 |

*Primary Examiner*—Sherman D. Basinger
*Assistant Examiner*—Thomas J. Brahan
*Attorney, Agent, or Firm*—Kokjer, Kircher, Bradley, Wharton, Bowman & Johnson

[57] ABSTRACT

A transparent drain plug for the submersible transmission case of an outboard marine engine. The transparency of the plug permits the lubricating oil in the transmission to be viewed to determine by its color whether and to what extent water has seeped into the transmission. The plug has a special configuration which provides it with a lens effect to enhance the visibility of the transmission case interior.

20 Claims, 1 Drawing Sheet

VISUAL INDICATING PLUG FOR OUTBOARD MARINE ENGINES

BACKGROUND AND SUMMARY OF THE INVENTION

This invention relates generally to outboard marine engines and more particularly to a transmission drain plug which is transparent in order to provide a quick visual indication of whether and to what extent water has seeped into the submersible transmission case of an outboard engine.

In outboard marine engines, the transmission is contained in a lower unit which is submerged in normal use. Consequently, even though the submersible transmission case is equipped with various types of gaskets and other seals, water can at times leak past the seals and seep into the transmission case. If water seeps into the transmission to any significant extent, it can severely impair the lubricating ability of the transmission oil. As a result of this contamination of the oil by water seepage, the gears, bearings, shaft and other parts of the drive line can be damaged or destroyed, often necessitating costly and time consuming repairs.

The lower unit of an outboard engine normally includes two plugged openings. One opening is located on top of the transmission and is used to add oil to the transmission case, and the other opening is located at the bottom of the transmission and is used for the drainage of oil. At present, the only method of determining whether water has seeped into the transmission involves draining oil from the drain opening so that it can be visually inspected for the presence of water. It is then necessary to replenish the oil through the fill opening.

At least in part because of the time and difficulty involved in carrying out this inspection procedure, most boat owners check the oil condition no more often than once a year, usually when the engine is being prepared for winter storage or inspected to determine if damage has occurred during the boating season. Annual inspection too infrequent to reliably detect the presence of water before it can cause damage. As a consequence, the transmissions of many outboard engines become damaged by water seepage before the problem is discovered.

The present invention meets a long felt need in the outboard marine industry in that it provides a quick and easy way for the owners and operators of outboard engines to determine whether water has seeped into the submersible lower unit which includes the transmission. In accordance with the invention, the normal drain plug of the transmission case is removed and replaced by a special plug which serves both to plug the drain opening and to provide an easily visible indication of the condition of the lubricating oil in the transmission. The plug is transparent so that the transmission oil can be sighted through it and its color indicates the water content, if any. If the transparent plug indicates a blue, black or green color, the oil condition is good and water seepage has not occurred. If the plug indicates yellow or amber, some water has leaked into the transmission and mixed with the oil. A clear indication means that fairly large quantities of water have seeped into the transmission case and it is necessary to take immediate corrective measures in order to avoid damage.

Although transparent plugs and various types of sight glasses have been employed in the past in connection with checking various engine fluids, to my knowledge transparent plugs have not been used on the submersible transmission case of an outboard marine engine. It is a particularly important feature of the invention that the transparent plug has a special configuration that creates magnification in order to enhance the visibility of the transmission case interior. The tip of the plug and the outer surface of its head are both convex surfaces which provide a lens effect. A specially shaped cavity in the plug enhances the lens effect to provide enough magnification that the oil condition can be easily observed from a distance of 8–10 feet. As a result, water that seeps into the transmission case can be detected at an early enough stage to prevent damage to the components of the transmission.

DETAILED DESCRIPTION OF THE INVENTION

In the accompanying drawing which forms a part of the specification and is to be read in conjunction therewith and in which like reference numerals are used to indicate like parts in the various views.

Figure 1:
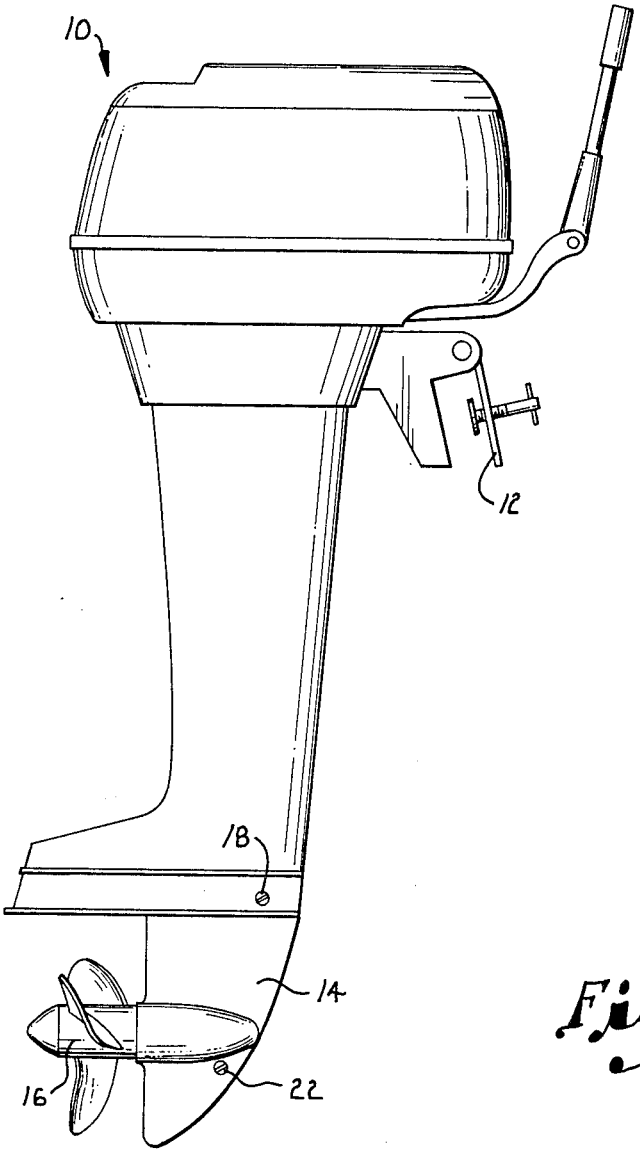
FIG. 1 is a side elevational view of an outboard marine engine having its lower unit equipped with a transparent drain plug constructed according to a preferred embodiment of the present invention.

Referring now to the drawing in more detail and initially to FIG. 1, numeral 10 generally designates a gasoline powered outboard marine engine which may be constructed in a conventional manner. The engine 10 may be mounted on a boat by means of a mounting bracket 12. The drive line extends downwardly from the engine 10 to a submersible lower unit which includes a transmission case 14 housing a conventional transmission (not shown). The output end of the transmission drives a submersed propeller 16 in order to provide motive power for advancing the boat. The transmission case 14 includes gears, shafts, bearings and other standard components (not shown), and the transmission case 14 is normally filled with transmission oil for lubrication of the components of the transmission. The oil is added to the transmission case through a fill opening near its top end which is normally closed by a fill plug 18. An internally threaded drain opening 20 (FIG. 3) is formed in the wall of the transmission case 14 near its lower end and is normally closed by a specially constructed plug which is identified by reference numeral 22.

Figure 2:
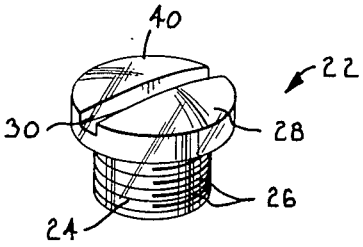
FIG. 2 is a perspective view on an enlarged scale of the transparent drain plug.
Figure 3:
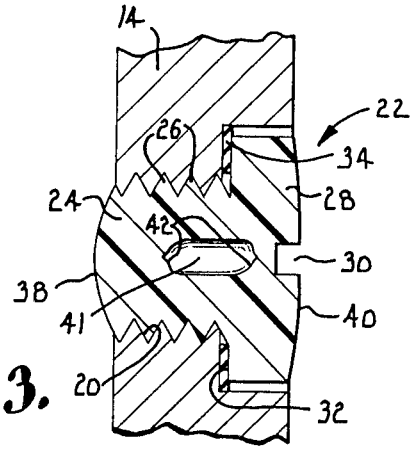
FIG. 3 is a fragmentary sectional view taken through the wall of the transmission case and showing the transparent drain plug installed in the threaded drain opening of the transmission.

The details of the plug 22 are best shown in FIGS. 2 and 3. The plug 22 has a shank 24 provided with external threads 26 which mate with the internal threads in the drain opening 20. Preferably, the threads 26 are standard ⅜" bolt threads which mate with the standard ⅜" bolt threads that are normally provided on the drain opening 20. At its outer end, the shank 24 is connected integrally with an enlarged head 28 having a screw driver slot 30 on its outer surface. The inner surface of the head 28 provides a flat annular shoulder 32 outwardly of shank 24 which seats flatly in a recess of the transmission case when the shank is fully threaded into opening 20. The shoulder 32 also acts against a flat marine gasket 34 which is located in the recess. The gasket provides a fluid tight seal in order to prevent the oil within the transmission case from leaking out.

The plug 22 serves both to seal the drain opening 20 and to provide a quick and easy way to check the condition of the oil located within the transmission case. In order to perform the latter function, the plug 22 is constructed from a transparent material such as a plastic which exhibits the necessary hardness and other desirable characteristics. Acrylics, polycarbons, and LEXAN plastic may be used for the plug 22, as may other suitable transparent materials. Preferably, the shank 24 and head 28 are formed as a single integral piece.

In order to provide magnification which enhances the visibility of the interior of the transmission case 14, plug 22 has a special configuration. The inner end or tip of the shank 24 provides a convex surface 38 which faces into the transmission case. Because of its convex shape, surface 38 acts as a lens which magnifies the light that passes through it from the transmission case interior. The outer surface of the enlarged head 28 is also a convex surface 40 which faces outwardly and thus also serves as a lens in order to magnify the light passing through the plug 22.

A specially shaped cavity 41 is formed in plug 22. Cavity 41 is centered on the longitudinal axis of plug 22 and is located partially in the shank 24 and partially in the head 28. The opposite end surfaces 42 of cavity 41 are formed as concave surfaces located internally of plug 22 on its longitudinal axis (which is also its optical axis). The presence of these two concave surfaces 42 within the plastic plug 22 provides an additional lens effect which enhances the magnification provided by the plug and adds to its optical properties.

The special transparent plug 22 may be provided either as an original part of the outboard engine 10 or it may be installed later in place of the drain plug normally provided to close the drain opening 20. In either case, the drain plug 22 acts to close the drain opening 20 and prevent the leakage of transmission oil out of the transmission case 14. When the oil is to be drained, plug 22 may be threaded out of opening 20 to allow drainage through the drain opening before the plug is replaced. Equally important, the plug 22 provides an effective seal which prevents water from seeping into the transmission case. It is noted that the transmission case 14 is submerged in the water in normal use and is thus highly subject to having water leak past its seals and into the transmission case where it can mix with the lubricating oil and detract from its lubricating effect.

In addition to closing the drain opening 20, plug 22 provides a visual indicating device which permits the condition of the transmission oil to be quickly and easily checked at a glance. By sighting through the plug 22 and the drain opening 20, the interior of the transmission case and the oil it contains can be viewed. If the oil appears through plug 22 as a black, blue or dark green color, an indication is provided that the oil is in good condition and that water has not leaked into the transmission case in any significant quantity. If the color yellow or amber is viewed through the plug 22, an indication is provided that some water has seeped into the transmission case and mixed with the oil. In this situation, the oil and water should be drained from the transmission case as soon as possible and replaced with fresh oil. If the inside of the transmission case appears to be clear when viewed through the plug 22, an indication is provided that a large quantity of water has managed to leak into the transmission case 14. In this situation, the possibility of the components of the transmission being damaged is great, and corrective measures should be taken immediately. The transmission case should be immediately drained and all of the gaskets and seals should be inspected and replaced if necessary prior to filling the transmission case with fresh oil.

In this manner, the transparent plug 22 provides a clear visual indication as to whether and to what extent water has seeped into the transmission case. Checking of the oil condition can be carried out merely by sighting through the plug 22. Due to its special configuration and the magnification provided by the lens type construction of plug 22, the oil condition can normally be checked from a distance of 8–10 feet.

Because the transparent plug of the present invention allows the submerged transmission case to be quickly and easily checked for the presence of water, the owners and operators of outboard marine engines can frequently check for water seepage and can take corrective measures if necessary before the transmission has been damaged and requires costly and time consuming repairs.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In an outboard marine engine having a submersible transmission case carrying lubricating oil and presenting a threaded drain opening at a location below the normal oil level for draining oil from the transmission case, an improved drain plug comprising a shank having exterior threads sized to mate with the threads of the drain opening to permit the shank to be threaded into the drain opening to close same and an enlarged head on said shank for engagement with the outside of the transmission case when said shank is threaded into the drain opening, said shank and head being transparent to provide visibility of the oil in the interior of the transmission case therethrough for visibly indicating the presence or absence of water seepage into the transmission case while the drain plug remaining in place in the drain opening.

2. The drain plug of claim 1, wherein:

said shank terminates in a tip on an inner end of the shank remote from the head; and said tip presents a convex surface which acts as a lens to provide magnification of the interior of the transmission case.

3. The drain plug of claim 2, including a cavity in said shank shaped to provide magnification of light passing longitudinally through the shank.

4. The drain plug of claim 3, including a convex surface on said head providing magnification of light passing therethrough.

5. The drain plug of claim 2, including a convex surface on said head providing magnification of light passing therethrough.

6. The drain plug of claim 1, including a cavity in said shank shaped to provide magnification of light passing longitudinally through the shank.

7. The drain plug of claim 6, including a convex surface on said head providing magnification of light passing therethrough.

8. The drain plug of claim 1, including a oonvex surface on said head providing magnification of light passing therethrough.

9. In a gasoline powered outboard marine engine having a submersible propeller turned by a drive line which includes a transmission housed in a submersible transmission and having a fill opening and a threaded drain opening, located below the fill opening at a level below the normal level of the oil in the transmission case, a device for providing a visual indication of the presence of water in the transmission case, comprising:

a plug having a shank presenting threads sized to mate with the threads of the drain opening and an enlarged head for contacting the outside of the transmission case when said shank is fully threaded into the drain opening to close same;

said shank and head being integral with one another as a single piece which is transparent to permit sighting through the plug to visually indicate by the color of the transmission case contents whether and to what extent water has seeped into the lubricating oil; and lens means on pug for providing magnification of the light rays passing therethrough.

10. The device of claim 9, wherein said lens means comprises an inner end of said shank presenting thereon a convex surface acting as a lens to provide magnification of the light passing through the plug.

11. The device of claim 10, wherein said lens means further comprises a cavity in said plug shaped to provide magnification of light passing therethrough.

12. The device of claim 11, wherein said lens means further comprises a convex surface on said head acting as a lens to provide magnification of the light passing through the plug.

13. The device of claim 10, wherein said lens means further comprises a convex surface on said head acting as a lens to provide magnification of the light passing through the plug.

14. The device of claim 9, wherein said lens means comprises a cavity in said plug shaped to provide magnification of light passing therethrough.

15. The device of claim 14, wherein said lens means further comprises a convex surface on said head acting as a lens to provide magnification of the light passing through the plug.

16. The device of claim 9, wherein said lens means comprises a convex surface on said head acting as a lens to provide magnification of the light passing through the plug.

17. A combination drain plug and visual indicating device for a submersible outboard engine transmission case having a threaded drain opening located below the normal oil level therein for draining oil from the transmission case, comprising:

a plug having a threaded shank for threading into the drain opening to close same, said shank having inner and outer ends;

an enlarged head on the outer end of said shank, said head and shank being transparent to permit sighting through the plug to visually indicate by the color of the transmission case contents whether and to what extent water has seeped into the transmission case and diluted the oil therein; and a convex surface on said inner end of the shank acting as a lens to provide magnification of the light rays passing through the plug.

18. The invention of claim 17, including a cavity in said plug shaped to provide magnification of light passing therethrough.

19. The invention of claim 18, including a convex surface on said head acting as a lens to provide magnification of the light passing through the plug.

20. The invention of claim 17, including a convex surface on said head acting as a lens to provide magnification of the light passing through the plug.

* * * * *